US005901622A

United States Patent [19]

Sweeny

[11] Patent Number: 5,901,622

[45] Date of Patent: May 11, 1999

[54] HAND TOOL WITH REVERSIBLE SHAFT

[75] Inventor: Brian A. Sweeny, Waterloo, Canada

[73] Assignee: Maxtech, Inc., Roseville, Mich.

[21] Appl. No.: 08/892,235

[22] Filed: Jul. 14, 1997

[51] Int. Cl.[6] ..... B25B 23/00

[52] U.S. Cl. ..... 81/439; 7/165

[58] Field of Search ..... 7/165, 167, 170; 81/437, 438, 439

[56] References Cited

U.S. PATENT DOCUMENTS

| | | | |
|---|---|---|---|
| 2,378,775 | 6/1945 | Johnson | 81/438 X |
| 3,023,015 | 2/1962 | Pankow | 81/437 X |
| 3,114,401 | 12/1963 | Johnson | 81/438 |
| 4,779,493 | 10/1988 | White | 81/438 |
| 5,265,504 | 11/1993 | Fruhm | 81/439 |
| 5,749,271 | 5/1998 | Liu | 81/438 X |

*Primary Examiner*—James G. Smith
*Attorney, Agent, or Firm*—R. Craig Armstrong

[57] ABSTRACT

A hollow handle accommodates a reversible shaft with a different functionality at each end. According to the preferred embodiment of the invention, a first end of the shaft is configured with an integral telescoping magnetic pick up tool, and a second end of the shaft is adapted to receive modular double-ended screwdriver bits. The reversible shaft is retained within the handle by a conventional spring loaded ball configuration located at the mid-point of the shaft and is prevented from rotating within the handle by preferably two wings projecting radially outwardly from the shaft. The spring loaded ball and the two wings are retained within a corresponding recess and two co-operating slots, respectively. The recess and slots are defined in a metal sleeve molded into the handle.

10 Claims, 2 Drawing Sheets

HAND TOOL WITH REVERSIBLE SHAFT

BACKGROUND OF THE INVENTION

FIELD OF THE INVENTION

This invention relates to hand tools, and in particular, to a screwdriver or nutdriver or the like. For convenience, the specification will refer to "screwdrivers", but it should be clearly understood that it is a convenience only, and does not exclude other similar tools.

Screwdrivers with a shaft adapted to retain modular bits which are stored in either the handle or the shaft are well known. Similarly, screwdrivers with modular shafts for different types of screws which are stored in the handle are also well known. However, greater flexibility is often desirable, and accordingly, it would be advantageous to create a self-contained tool which can possess an additional function other than that of a screwdriver.

SUMMARY OF THE INVENTION

In the invention, a preferably hollow handle accommodates a reversible shaft with a different functionality at each end. For example, the shaft could have an aperture at one end to preferably retain modular double-ended screwdriver bits, and at the other end, be configured with, for example, a conventional telescoping magnetic pick-up tool.

The reversible shaft is retained within the handle by any suitable means, such as a conventional spring loaded ball preferably located at the mid-point of the shaft and is prevented from rotating within the handle by preferably two wings projecting radially outwardly from the shaft. The spring loaded ball and the two wings are retained within a corresponding recess and two co-operating slots, respectively. The recess and slots, preferably are defined in a metal sleeve molded into the handle.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
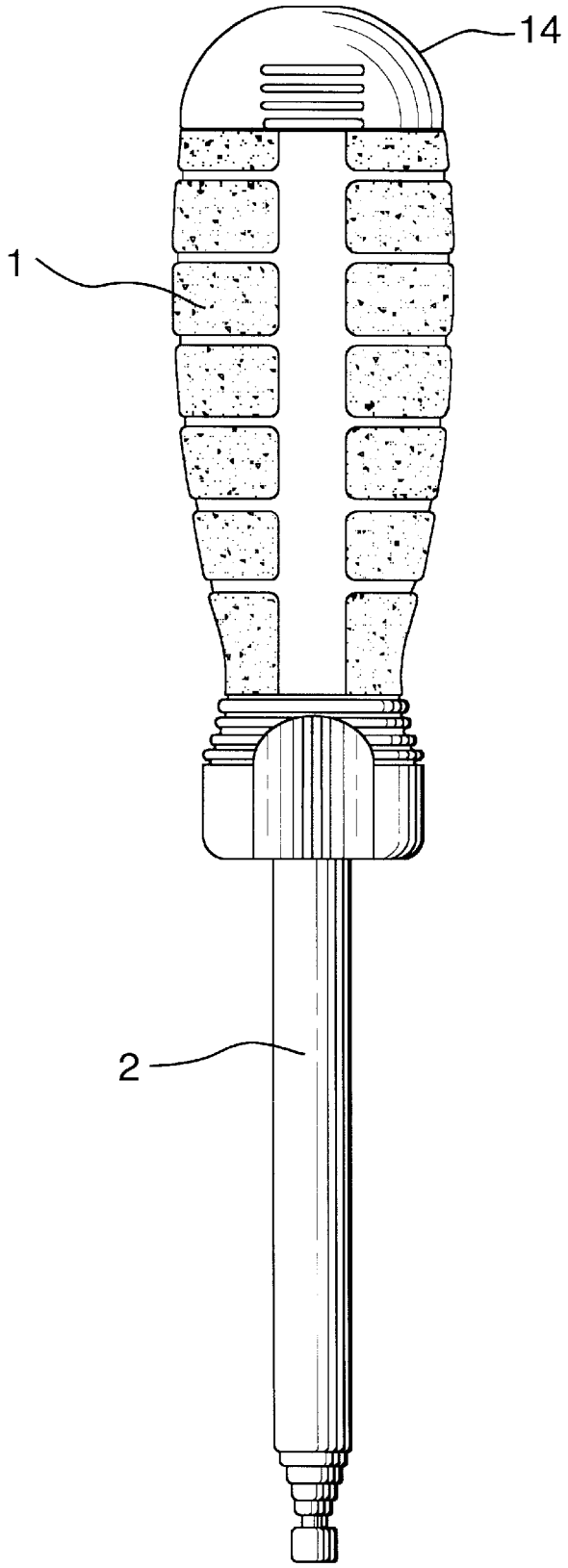
FIG. 1 is a plan view of the invention.
Figure 2:
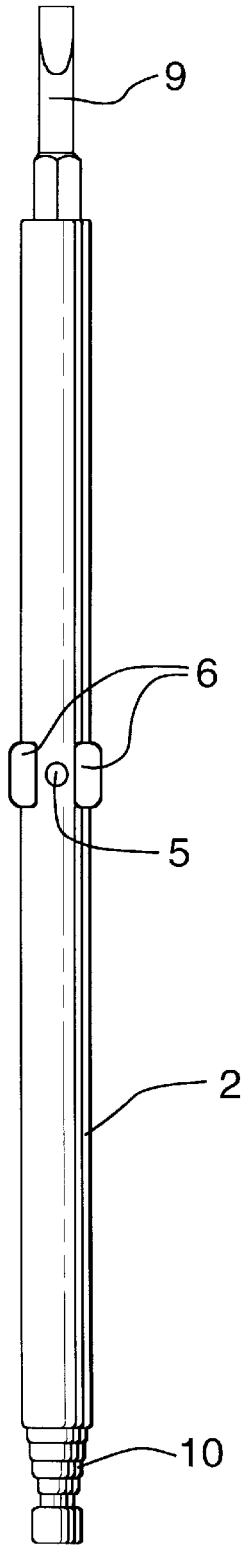
FIG. 2 is a plan view of the reversible shaft.
Figure 3:
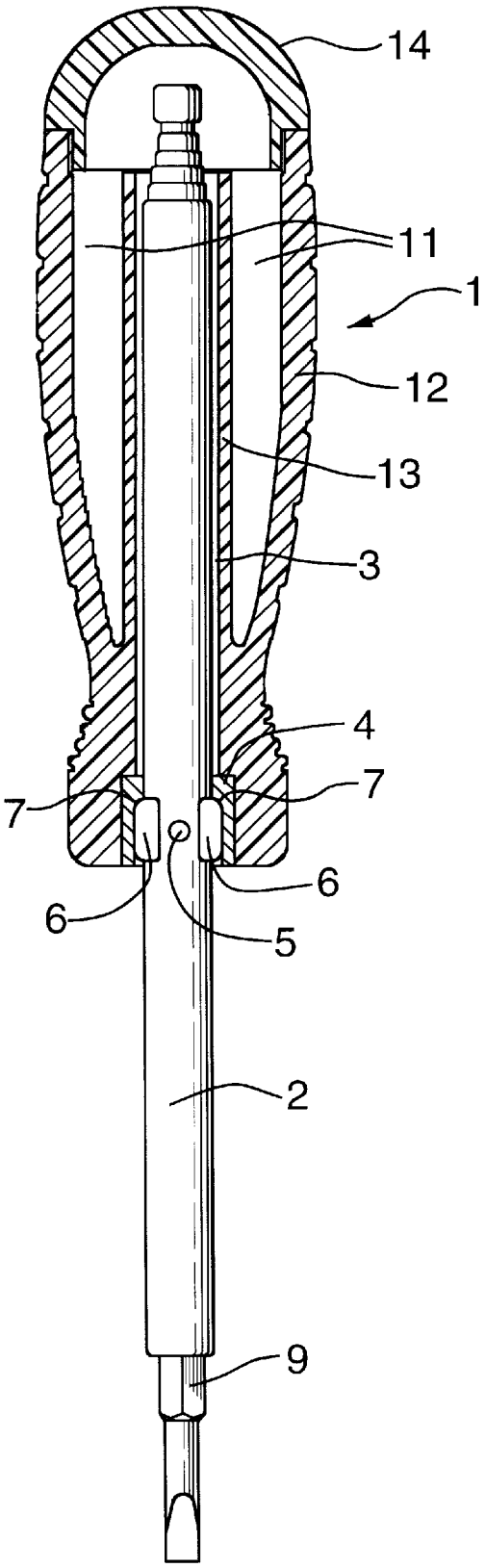
FIG. 3 is a cross-sectional view of the invention through the center.
Figure 4:
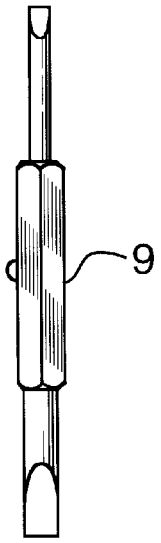
FIG. 4 is a view of a standard double end bit.

As best shown in FIG. 3, a preferably hollow plastic handle 1 is adapted to receive a reversible shaft 2 via a substantially cylindrical opening 3 extending axially from the bottom of the handle through preferably most of the length of the handle. A metal sleeve 4 is preferably molded to a co-operating section of the inner wall 13 closest to the bottom of the handle. Alternatively, the metal sleeve could be pressed into the handle.

The reversible shaft 2 is secured to the handle by a conventional spring loaded ball arrangement 5 preferably located at the mid-point of the shaft, which is received by a corresponding recess (not shown) defined within the metal sleeve 4. To prevent the shaft from rotating within the handle, preferably two wings 6 protrude radially outward from the shaft and are received by two co-operating slots 7 in the metal sleeve. Also, the wings bear against the upper end of the slots, thereby preventing the shaft 2 from moving toward the handle when the user, for example, presses the tool into the screw.

Figure 5:
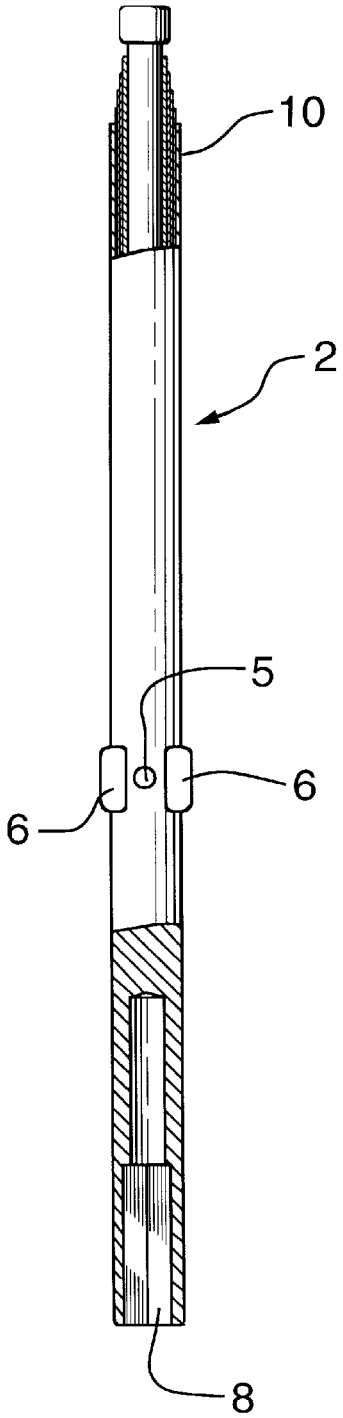
FIG. 5 is a cut-away view of the two ends of the reversible shaft.

FIG. 5 shows the preferred embodiment of the invention, where a first end of the reversible shaft 2 is configured as a conventional telescoping magnetic tool 10 to allow a user to pick up small metal objects that have fallen through narrow openings where a human hand cannot reach or simply allow the user the option to pick up an object which has fallen without extraneous exertion, such as bending over. Preferably, the telescoping magnetic tool is an integral part of the shaft, but can also be a separate component securable to the shaft, and such a variation would clearly be within the scope of this invention.

As best shown in FIG. 5, an opening 8 is defined within a second end of the shaft to retain conventional double-ended screwdriver bits 9. Alternatively, the shaft may be configured to only retain single-ended screwdriver bits.

FIG. 3 shows that additional screwdriver bits may be stored within a storage compartment 11 in the handle 1 bounded by the outer wall of the handle 12 and the cylindrical inner wall 13 surrounding the cylindrical opening 3. The storage compartment is preferably accessed by removing a plastic cap 14, which is screwed onto a co-operating threaded section of the handle. Alternatively, the storage compartment may be accessed by a conventional spring-loaded pull-and-turn cap.

To change the function of the tool from a screwdriver to a telescoping tool, the user need only pull out the reversible shaft 2 and re-insert it with the telescoping tool facing outward. The cylindrical opening 3 can accommodate the shaft with the screwdriver bit, so that the user does not necessarily have to remove the bit from the shaft and store it before changing functionalities.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, the two ends of the reversible shaft can be configured for a large number of dual function hand tool combinations.

Also, the tool handle does not have to be hollow, but can be made from a solid piece of plastic with a cylindrical opening to accommodate the reversible shaft.

What is claimed as the invention is:

1. A hand tool comprising, a handle;

a shaft securable within said handle by a ball mounted within said shaft, said ball being spring-biased to extend through a hole in said shaft configured to engage a corresponding recess defined in a sleeve mounted within said handle, said shaft configured for a different functionality at each end thereof, said shaft interchangeably positionable within said handle in either one of:

a first position where a first end of said shaft locates within said handle, said first end of said shaft comprises a telescoping magnetic tool and a second end of said shaft project outwardly from said handle, and a second position where said second end of said shaft locates within said handle and said first end of said shaft projects outwardly from said handle.

2. A hand tool as defined in claim 1, wherein said second end of said shaft is adapted to receive screwdriver bits.

3. A hand tool as defined in claim 2, wherein said handle further comprises a storage compartment defined within said handle, and a cap securable to said handle.

4. A hand tool as defined in claim 1, wherein said magnetic tool is of a screwdriver blade configuration.

5. A hand tool comprising, a handle;

shaft securable within said handle, said shaft configured for a different functionality at each end thereof, said shaft interchangeably positionable within said handle in either one of a first position where a first end of said shaft locates within said handle, said first end of said shaft comprises an integral telescoping magnetic tool and a second end of said shaft project outwardly from said handle, and a second position where said second end of said shaft locates within said handle and said first end of said shaft projects outwardly from said handle.

6. A hand tool as defined in claim 5, wherein said second end of said shaft is adapted to receive screwdriver bits.

7. A hand tool as defined in claim 6, wherein said handle further comprises a storage compartment defined within said handle, and a cap securable to said handle.

8. A hand tool as defined in claim 5, wherein said magnetic tool is of a screwdriver blade configuration.

9. A hand tool comprising, a handle having a storage compartment defined within said handle, and a cap securable to said handle;

a shaft securable within said handle, said shaft configured for a different functionality at each end thereof, said shaft interchangeably positionable within said handle in either one of a first position where a first end of said shaft locates within said handle and a second end of said shaft project outwardly from said handle, said second end of said shaft is adapted to receive screwdriver bits, and a second position where said second end of said shaft locates within said handle and said first end of said shaft projects outwardly from said handle.

10. A hand tool as defined in claim 9, wherein said magnetic tool is of a screwdriver blade configuration.

* * * * *